10/15/85 OR 4,547,338

United States Patent [19]

Grobner et al.

[11] Patent Number: 4,547,338

[45] Date of Patent: Oct. 15, 1985

[54] FE-NI-CR CORROSION RESISTANT ALLOY

[75] Inventors: Paul J. Grobner, Ann Arbor; Armand P. Bond, Livonia; Abraham Poznansky, Ann Arbor, all of Mich.

[73] Assignee: AMAX Inc., Greenwich, Conn.

[21] Appl. No.: 681,730

[22] Filed: Dec. 14, 1984

[51] Int. Cl.[4] ..... C22C 30/00

[52] U.S. Cl. ..... 420/584; 420/583

[58] Field of Search ..... 420/584, 583

[56] References Cited

U.S. PATENT DOCUMENTS 4,464,335 8/1984 Brandis et al. ..... 420/584

4,487,744 12/1984 DeBold et al. ..... 420/584

FOREIGN PATENT DOCUMENTS 44-23420 4/1969 Japan ..... 420/584

59-59863 5/1984 Japan ..... 420/584

316164 7/1929 United Kingdom ..... 420/584

*Primary Examiner*—Veronica O'Keefe

*Attorney, Agent, or Firm*—Michael A. Ciomek; Eugene J. Kalil

[57] ABSTRACT

Directed to a corrosion resistant alloy particularly designed for use in power plant exhaust gas scrubbers which contains about 0.015% to about 0.025% carbon, not more than about 1% manganese, not more than about 0.3% silicon, about 19% to about 22% chromium, about 8.5% to about 9.5% molybdenum, about 30% to about 42% nickel, up to about 0.2% nitrogen, with the nickel and nitrogen contents being so related that at about 30% nickel, the nitrogen content is at least about 0.15%, while at a nickel content of at least about 40%, the nitrogen content does not exceed about 0.03%, the balance being essentially iron, with the iron content in the range of about 28% to about 40%.

4 Claims, No Drawings

FE-NI-CR CORROSION RESISTANT ALLOY

The invention is directed to an alloy having a high combination of mechanical properties, impact resistance and corrosion resistance, particularly for use in scrubber applications.

BACKGROUND OF THE INVENTION AND THE PRIOR ART

In recent years the need to remove sulfur oxides from flue gases generated by the combustion of coal has become more apparent. A number of factors have contributed to this need, including the increasingly strong connection between emission of sulfur oxides from coal-fired power plants and the phenomenon of acid rain, which acidifies lakes and is harmful to fish and plant life; the economic need to use coal for generating electricity due to the reduced reliability of low-sulfur oil imports, etc. However, the construction of properly functional liquid scrubbing systems has developed a new set of problems and many millions of dollars have already been expended in attempting to deal with them.

Almost of necessity, scrubbing systems need to be fabricated of metal. It has been found that attempts to construct such systems of ordinary constructional steels or even of common grades of stainless steels have resulted in failure. Thus, coals used for power generation contain varying levels of sulfur, chlorides, fluorides and other impurities which are absorbed within the liquid scrubbing media used to contact the resulting flue gases. Water and chemicals used in the scrubbing process also contribute to the buildup of chlorides within the scrubber. Chloride buildup to quite astonishing levels occurs in recirculating systems which are resorted to in order to minimize water consumption and pollution problems resulting from release of dilute solutions. Chloride concentrations in closed loop systems as high as 50,000 ppm (5%) have been reported.

Alloys are available which have the combinations of properties, including strength, ductility, impact resistance and corrosion resistance required for scrubber service, but the available alloys are expensive. U.S. Pat. Nos. 2,703,277, 3,160,500 and 3,203,792 may be referred to as disclosing alloys useful in scrubber service.

The present invention is directed to provision of alloys suitable for use in scrubber service at a lower cost than that of available alloys.

BRIEF DESCRIPTION OF THE INVENTION

The invention is directed to alloys containing about 0.015% to about 0.025% carbon, not more than about 1% manganese, not more than about 0.3% silicon, about 19% to about 22% chromium, about 8.5% to about 9.5% molybdenum, about 30% to about 42% nickel, up to about 0.2% nitrogen, with the proviso that, at about 30% nickel, the nitrogen content is at least about 0.15% and that when nickel is at least 40%, the nitrogen content does not exceed about 0.03%, and the balance essentially iron, the iron content being about 28% or 30% to about 40%. The alloy is usually employed in the solution-treated condition resulting from a heating at a temperature of at least about 1000° C., e.g., 1150° C. Preferably, the alloys contain nickel in the range of about 40% to about 42%.

DETAILED DESCRIPTION OF THE INVENTION

Six 29 kg (65 lb) heats were produced in a vacuum induction furnace and cast into cylindrical ingots under one half atmosphere of argon. The compositions are given in Table 1. The ingots were machined to blanks 79 mm (3.13 in.) in diameter and 178 mm (7 in.) long, extruded to round bar 33 mm (1.3 in.) in diameter at 1150° C. (2100° F.), and rolled to 19 mm (0.75 in.) square bars from the same reheat temperature. The bars were annealed at 1150° C. (2100° F.) for 30 min and water quenched.

Room-temperature tensile tests were performed on round specimens with a gauge diameter of 6.35 mm (0.25 in.) and a gauge length of 25 mm (1.0 in.). The strain rate was 18%/h in the elastic range and 300%/h in the plastic range.

Impact tests were performed on full-size Charpy V-notch specimens at −100° C. (−148 F.). Tensile and impact results are given in Table 2.

TABLE 1

| Alloy | Element, % | | | | | | | | |
|---|---|---|---|---|---|---|---|---|---|
| | C | Mn | Si | Cr | Ni | Mo | P | S | N |
| 30Ni—0.003N | 0.016 | 0.49 | 0.20 | 19.48 | 30.31 | 8.75 | 0.0037 | 0.0035 | 0.0028 |
| 30Ni—0.18N | 0.019 | 0.50 | 0.19 | 19.62 | 30.45 | 8.71 | 0.0039 | 0.0043 | 0.178 |
| 40Ni—0.003N | 0.019 | 0.51 | 0.20 | 19.39 | 39.90 | 8.97 | 0.0011 | 0.0026 | 0.0026 |
| 40Ni—0.19N | 0.017 | 0.50 | 0.24 | 19.20 | 40.17 | 8.87 | 0.0043 | 0.0036 | 0.188 |
| 50Ni—0.003N | 0.017 | 0.50 | 0.32 | 19.56 | 49.62 | 9.00 | 0.0011 | 0.0026 | 0.0036 |
| 50Ni—0.14N | 0.011 | 0.50 | 0.21 | 19.57 | 50.25 | 8.80 | 0.0015 | 0.0027 | 0.136 |

TABLE 2

| Alloy | 0.2% Offset Yield Strength, | | Tensile Strength, | | Elongation, % | Reduction of Area, % | Charpy V-Notch Impact-100° C. | |
|---|---|---|---|---|---|---|---|---|
| | MPa | (ksi) | MPa | (ksi) | | | Joules | (Ft. Lb.) |
| 30Ni—0.003N | 276 | (40) | 634 | (92) | 51 | 61 | 150 | 110 |
| 30Ni—0.18N | 372 | (54) | 772 | (112) | 56 | 63 | 210 | 160 |
| 40Ni—0.003N | 283 | (41) | 641 | (93) | 53 | 76 | 170 | 135 |
| 40Ni—0.19N | 365 | (53) | 793 | (115) | 59 | 70 | 250 | 190 |
| 50Ni—0.003N | 310 | (45) | 683 | (99) | 52 | 75 | 315 | 235 |
| 50Ni—0.14N | 359 | (52) | 772 | (112) | 64 | 74 | 255 | 195 |

The results show that the presence of nitrogen improves yield strength significantly, especially at the 30% nickel level. Adequate room temperature ductility is shown. All alloys also displayed high impact energies.

Nitrogen improved impact resistance at 30% and 40% nickel.

The alloys, all in the form of 3 mm ($\frac{1}{8}$ inch) sheet solution annealed at 1150° C. (2100° F.) and water quenched, were then subjected to corrosion testing.

Corrosion coupons for the simulated scrubber test were 25 by 19 mm (1 by 0.75 in.) in size with a 6.35 mm ($\frac{1}{4}$ in.) diameter hole in the center. Coupons were polished through 600-grit metallographic papers. The crevices were applied by specially prepared high density polyethylene serrated washers 12.7 mm (0.5 in.) in outside diameter with an inside diameter of 7.1 mm (0.28 in.). The grooves in the washer formed 12 separate crevice contacts per washer so that with a washer on each side of the coupon a total of 24 crevices were formed per specimen. The washers were secured by a PVC nut and bolt torqued to 0.6 N·m (5 in.-lb).

To simulate conditions in a flue gas scrubber, specimens were tested in $CaCl_2$ solution containing 30,000 mg/l $Cl^-$ at initial pH 3 under continuous bubbling of $SO_2$ and $O_2$ through the solution. The initial solution also contained 625 mg of $CaSO_4$ and 625 mg of $CaCO_3$ per liter solution to simulate the slurry inside a scrubber. Tests were run for two days at 60° C. (140° F.). The final pH of the test solution was less than 1 because of the precipitation of calcium sulfite. The specimens were examined for corrosion under the serrated washer and the depth of all observed corroded regions was measured by means of an optical microscope.

Crevice corrosion resistance of the alloys is set forth in Table 3.

TABLE 3

Crevice Corrosion Resistance Of Alloys In A Simulated Scrubber Environment[a]

| Alloy | Maximum Pit or Crevice Corrosion Depth (Microns) | Number of Crevice Sites Attached Out of 24 Total |
|---|---|---|
| 30Ni—0.003N | 85 | 4 |
| 30Ni—0.18N | 0 | 0 |
| 40Ni—0.003N | 0 | 0 |
| 40Ni—0.19N | 118 | 4 |
| 50Ni—0.003N | 0 | 0 |
| 50Ni—0.14N | 0 | 0 |

[a]30,000 mg/l Cl (as $CaCl_2$), 625 mg $CaSO_4$ and 625 mg $CaCO_3$ per liter solution, with $SO_2$ and $O_2$ continuously bubbling through the solution at 60° C. (140° F.), 2 day test.

The 40Ni-0.19N alloy was susceptible to general corrosion while all others were free of general corrosion. Only the 30Ni-0.003N and 40Ni-0.19N alloys were susceptible to crevice corrosion in the simulated scrubber environments. The reduced crevice corrosion resistance of the two alloys is attributed to second phase particles that were observed in the microstructure of these alloys. Elimination of such precipitates can be attained by solution annealing at a higher annealing temperature.

The resistance to general corrosion in highly acidified environments was measured by exposing the alloys to 10% by volume (16.5% by weight) boiling sulfuric acid. Corrosion coupons 19×25 mm (0.75×1 in.) were polished through 600-grit metallographic papers and weighed. After exposure to the solution for 24 hours the samples were cleaned and reweighed and corrosion rates calculated from weight loss measurements.

The corrosion rates of the alloys exposed to boiling 10% sulfuric acid are given in Table 4. The two least corrosion resistant alloys in sulfuric acid solution were those described above as being susceptible to crevice corrosion in a simulated scrubber environment.

TABLE 4

Corrosion Rates Of Austenitic Alloys In 10% By Volume (16.5% By Weight) Boiling Sulfuric Acid, 24 Hours Test

| Alloy | Corrosion Rate, $mg/dm^2/day$ |
|---|---|
| 30Ni—0.003N | 5990 |
| 30Ni—0.18N | 2700 |
| 40Ni—0.003N | 1140 |
| 40Ni—0.19N | 6980 |
| 50Ni—0.003N | 1180 |
| 50Ni—0.14N | 4800 |

The resistance to crevice corrosion was characterized by determining the critical crevice temperature (CCT). The CCT is defined as the temperature above which the alloy becomes susceptible to crevice corrosion. Corrosion coupons 19×25 mm ($\frac{3}{4}$×1 in.) were machined and ground with 600-grit paper. Teflon cylinders were pressed against the two major faces of the coupons with a rubber band. Specimens were exposed for 24 hours at a controlled temperature in 10% $FeCl_3$ $6H_2O$ (pH=1) solution. Specimens susceptible to crevice corrosion were attached in the regions of contact (a) with the Teflon cylinders and (b) with the rubber bands. Tests were performed at intervals of 2.5° C. until the critical crevice temperature was reached.

Critical crevice corrosion temperatures for the alloys in 10% $FeCl_3$ $6H_2O$ solution are set forth in Table 5.

TABLE 5

| Alloy | Critical Crevice Temperature °C. |
|---|---|
| 30Ni—0.003N | 40 |
| 30Ni—0.18N | 32 |
| 40Ni—0.003N | 20 |
| 40Ni—0.19N | 20 |
| 50Ni—0.003N | −2.5 |
| 50Ni—0.14N | > −2.5 |

The critical crevice temperature for a standard alloy in the field INCONEL alloy 625 was 35° C. Thus, reducing nickel and nitrogen contents in the alloys studied improved the critical crevice temperature. It is to be noted that alloy 625 displayed a corrosion rate of 200 $mg/dm^2/day$ under the conditions of Table 4 and showed no pitting or crevice corrosion under the conditions of Table 3.

The surprising susceptibility to crevice corrosion of the 50% nickel alloys in the ferric chloride test, which demonstrated susceptibility over the entire ambient temperature range, strongly indicated the need to limit the nickel content of the alloys to a maximum of about 42%. For general purposes, a nickel range of about 40% to about 42% is preferred. All proportions are given herein in percent by weight. The alloys may contain small amounts of elements such as cobalt (up to about 1%), copper (up to about 3%) without harm. Impurities such as sulfur and phosphorus should be as low as possible. Because of the substantial iron content, the alloy can be produced using ferrochromium, thereby leading to substantial savings in product cost.

Micrographic examination of the alloys after solution annealing indicated that addition of a carbide-stabilizing amount of an element such as niobium or titanium to the alloys could be beneficial.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A corrosion-resistant alloy consisting essentially of about 0.015% to about 0.025% carbon, not more than about 1% manganese, not more than about 0.3% silicon, about 19% to about 22% chromium, about 8.5% to about 9.5% molybdenum, about 30% to about 42% nickel, up to about 0.2% nitrogen, with the nickel and nitrogen contents being so related that at 30% nickel, the nitrogen content is at least about 0.15%, while at a nickel content of at least about 40%, the nitrogen content does not exceed about 0.03%, and the balance essentially iron, said alloy being resistant to the corrosive effects encountered within the scrubbers employed in flue gas treatment to remove therefrom sulfur oxides generated by the burning of coal.

2. An alloy in accordance with claim 1 containing about 0.019% carbon, about 0.5% manganese, about 0.2% silicon, about 19.5% chromium, about 40% nickel, about 9% molybdenum and the balance essentially iron.

3. An alloy in accordance with claim 1 containing about 40% to about 42% nickel.

4. An alloy in accordance with claim 1 containing about 30% to about 40% iron.

* * * * *